US009328947B2

(12) United States Patent
Haussmann

(10) Patent No.: US 9,328,947 B2
(45) Date of Patent: May 3, 2016

(54) PLATE EVAPORATOR, IN PARTICULAR FOR A REFRIGERANT CIRCUIT

(75) Inventor: Roland Haussmann, Wiesloch (DE)

(73) Assignee: VALEO KLIMASYSTEME GMBH, Rodach (DE)

( * ) Notice: Subject to any disclaimer, the term of this patent is extended or adjusted under 35 U.S.C. 154(b) by 823 days.

(21) Appl. No.: 12/863,244

(22) PCT Filed: Jan. 16, 2009

(86) PCT No.: PCT/EP2009/000229

§ 371 (c)(1),
(2), (4) Date: Jan. 13, 2011

(87) PCT Pub. No.: WO2009/090073

PCT Pub. Date: Jul. 23, 2009

(65) Prior Publication Data

US 2011/0120182 A1 May 26, 2011

(30) Foreign Application Priority Data

Jan. 18, 2008 (DE) ..... 10 2008 005 077
Jan. 16, 2009 (WO) ..... PCT/EP2009/000229

(51) Int. Cl.
*F25B 39/02* (2006.01)
*F25B 41/00* (2006.01)

(52) U.S. Cl.
CPC ..... *F25B 39/022* (2013.01); *F25B 41/00* (2013.01); *F25B 2341/0012* (2013.01); *F25B 2500/18* (2013.01)

(58) Field of Classification Search
CPC ..... F25B 39/022; F25B 41/00; F25B 2341/0012; F25B 2500/18
USPC ..... 62/526, 524, 500, 503, 504
See application file for complete search history.

(56) References Cited

U.S. PATENT DOCUMENTS

| | | | | |
|---|---|---|---|---|
| 3,780,535 | A * | 12/1973 | Darredeau | 62/612 |
| 5,201,792 | A * | 4/1993 | Study | 62/503 |
| 6,026,655 | A * | 2/2000 | Griffin et al. | 62/503 |
| 6,834,514 | B2 * | 12/2004 | Takeuchi et al. | 62/500 |
| 6,920,922 | B2 * | 7/2005 | Takeuchi | 165/202 |
| 7,234,310 | B2 * | 6/2007 | Flynn et al. | 62/114 |
| 7,428,826 | B2 * | 9/2008 | Oshitani et al. | 62/500 |
| 8,365,552 | B2 * | 2/2013 | Brodie et al. | 62/500 |
| 2006/0196223 | A1 * | 9/2006 | Dexter et al. | 62/503 |
| 2007/0163294 | A1 * | 7/2007 | Aung et al. | 62/500 |
| 2009/0293535 | A1 * | 12/2009 | Aung et al. | 62/515 |

FOREIGN PATENT DOCUMENTS

| | | | | |
|---|---|---|---|---|
| DE | 19524660 | C1 * | 10/1996 | |
| EP | 1870648 | A1 | 12/2007 | |
| JP | 2002318019 | A * | 10/2002 | F24B 2339/047 |

OTHER PUBLICATIONS

PCT International Search Report for PCT/EP2009/000229, dated Jul. 8, 2009, 5 pages.

* cited by examiner

*Primary Examiner* — M. Alexandra Elve
*Assistant Examiner* — Larry Furdge
(74) *Attorney, Agent, or Firm* — Howard & Howard Attorneys PLLC

(57) ABSTRACT

Plate evaporator (14), in particular for a refrigerant circuit, having a pre-evaporator (18), a low temperature evaporator (28), and a post-evaporator (24) for refrigerant, all of which are integrated into a singular component, and furthermore having an inlet and an outlet for a heat transfer medium.

17 Claims, 6 Drawing Sheets

PLATE EVAPORATOR, IN PARTICULAR FOR A REFRIGERANT CIRCUIT

RELATED APPLICATIONS

This application claims priority to and all the advantages of International Patent Application No. PCT/EP2009/000229, filed on Jan. 16, 2009, which claims priority to German Patent Application No. DE 10 2008 005 077.6, filed on Jan. 18, 2008.

The invention relates to a plate evaporator, in particular for a refrigerant circuit, as is used as part of an air conditioning unit, in particular for a car.

A conventional refrigerant circuit has a compressor that compresses refrigerant that is subsequently conducted through a condenser. There, the refrigerant is either condensed and expanded in the liquid state in the ejector or the supercritical gas is cooled only and decompressed in the ejector so that subsequent to the decompression, the refrigerant consists in a mixture that is primarily in the liquid phase and primarily in the gas phase. These phases are separated in a separator, the primarily gas portion of the refrigerant being supplied anew to the compressor by means of an evaporator. The primarily liquid portion of the refrigerant is supplied to a second evaporator wherefrom it is suctioned into the ejector. The heat needed to evaporate the refrigerant in the evaporator can, for example, be drawn from the air that, once cooled, is then directed into the car interior.

Indirect circuits are also known in which the air to be cooled does not circulate about the evaporator, but rather a heat transfer medium circulates thereabout, said heat transfer medium drawing the energy needed for the evaporation of the refrigerant from the air to be cooled in a separate air heater. The problem herewith is that owing to the additional heat transfer from the heat transfer medium to the refrigerant, the level of efficiency tends to decrease.

The problem addressed by the invention consists in creating an evaporator for an indirect refrigerant circuit that is characterised by a high level of efficiency that is at least as effective as the level of efficiency of a direct refrigerant circuit.

To address this problem, according to the invention, a plate evaporator is provided, in particular for a refrigerant circuit, with a pre-evaporator, a low temperature evaporator, and a post-evaporator for refrigerants, all of which are integrated into a component, while an inlet and an outlet for a heat transfer medium are also provided as well. This evaporator is based on the fundamental idea of evaporating in a single evaporator the refrigerant after expansion in three steps. In a first step, a portion of the refrigerant is partially evaporated in the pre-evaporator. Thereafter, the primarily liquid portion of the refrigerant is evaporated in the low temperature evaporator. The primarily gas portion of the refrigerant is conducted through the post-evaporator so that subsequent thereto, the refrigerant exists in an entirely gaseous state.

According to one embodiment of the invention, an ejector is integrated into the plate evaporator. In this manner, a separate component is dispensed with that otherwise would have to have been separately joined thereto.

The ejector is preferably arranged above the low temperature evaporator and has a suction connection that is directly joined to the low temperature evaporator. The integration of the ejector at this location leads to a short flow path, a reduced pressure drop, and a compact construction.

According to one embodiment of the invention, a separator is integrated into the plate evaporator, which separator has a liquid-phase outlet and a gas-phase outlet. The low temperature evaporator is joined to the liquid-phase outlet and the post-evaporator is linked to the gas-phase outlet. The evaporation work is thus distributed amongst three specific evaporators, each evaporator being able to be specifically designed for each type of work. This design guarantees a high level of efficiency.

The separator is preferably situated beneath the pre-evaporator. This arrangement yields short flow paths since the refrigerant can be guided directly therefrom to the low temperature evaporator and the post-evaporator.

The plate block of the pre-evaporator preferably ends 15 to 50 mm above the floor of the separator. In this manner, it is possible to create with little effort the space in the plate evaporator for separating the primarily gas and the primarily liquid phases of the refrigerant.

A particularly high level of efficiency can be achieved if the evaporators are countercurrent evaporators. In this manner, it is possible to use the optimal temperature difference between the heat-transfer medium and the refrigerant for each of the different compression steps.

Advantageous embodiments of the invention are evident from the subclaims.

The invention is described below using a preferred embodiment that is represented in the attached drawings. Therein:

FIG. 1 schematically represents a refrigerant circuit according to the invention and having an evaporator according to the invention;

FIG. 2 schematically represents a cross section through the evaporator;

FIG. 3 schematically represents a cross section along the plane of FIG. 2;

FIG. 4 schematically represents a cross section along the plane IV-IV of FIG. 2;

FIG. 5 schematically represents a cross section along the plane V-V of FIG. 2;

FIG. 6 schematically represents a cross section along the plane VI-VI of FIG. 2;

FIG. 7 schematically represents the flow path of the heat transfer medium;

FIG. 8 schematically represents a detail of the separator;

Figure 1:
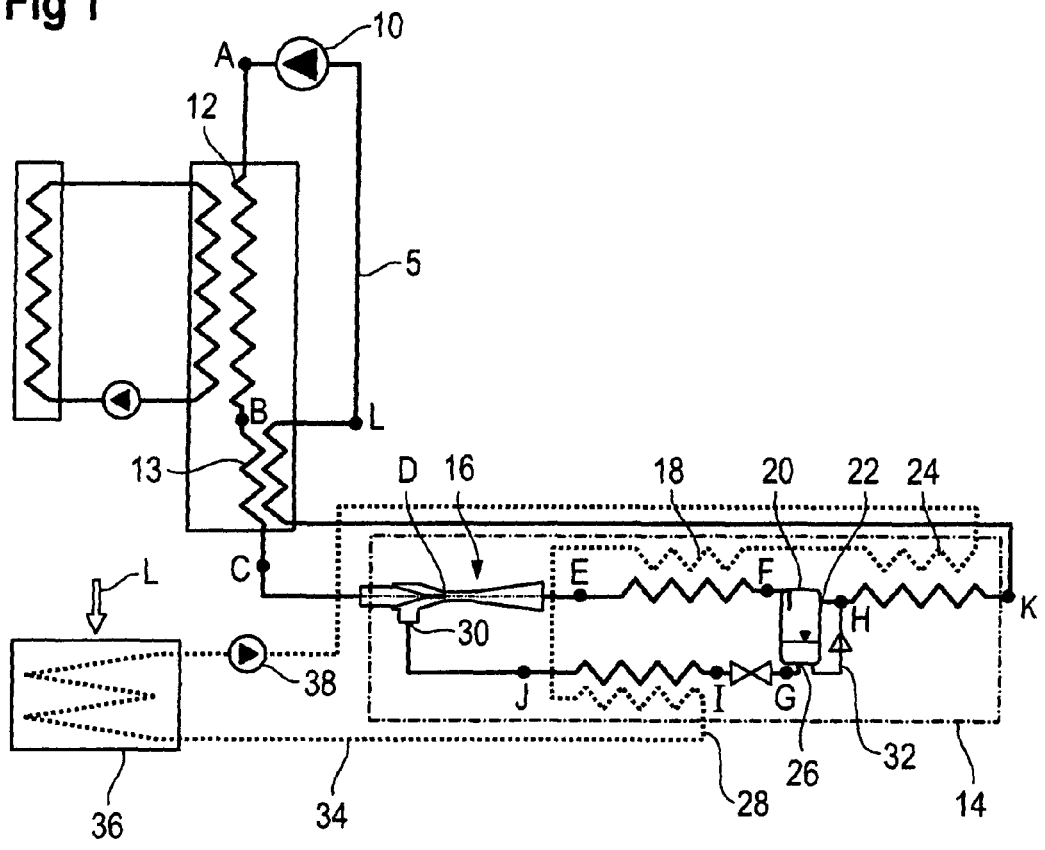

FIG. 1 shows a refrigerant circuit 5 that has an electrically driven compressor 10, a condenser or gas cooler 12, and an evaporator 14. The condenser or gas cooler 12 has an internal air heater 13 by means of which heat can be transferred from the refrigerant on the high-pressure side to the low-pressure side.

The evaporator 14 has an ejector 16 by means of which the refrigerant circulating in the refrigerant circuit can be expanded. On the low-pressure side, a pre-evaporator 18 is connected to the ejector 16, the outlet of said pre-evaporator being linked to a separator 20. The separator has a gas-phase outlet 22 that is joined to a post-evaporator 24. The outlet of the post-evaporator leads by way of the internal air heater 13 to the suction side of the compressor 10. The separator 20 is furthermore outfitted with liquid-phase outlet 26 to which the low temperature evaporator 28 is connected. The outlet of the low temperature evaporator 28 is linked to a suction connection 30 of the ejector 16. The separator 20 is moreover equipped with an oil return apparatus 32.

Each of the evaporator areas 18, 24, and 28 of the evaporator 14 is connected to a heater circuit 34, which has a heater 36 and a pump 38. Water and/or glycol can be used as a heat transfer medium in the heater circuit 34. The heater 36 is preferably designed as a cross-countercurrent heater and is part of an air conditioning unit. The heat transfer medium is led by the heater 36 first through the post-evaporator 24, thereafter through the pre-evaporator 18, and finally through the low temperature evaporator 28 prior to returning to the heater 36. All evaporation areas are designed as countercurrent evaporators.

During the operation of the refrigerant circuit, the refrigerant, which has been compressed by the compressor 10, is located at the outlet of the condenser 12, and is in a liquid or supercritical state, is conducted through the ejector 16 in which it expands. Subsequent thereto, said refrigerant then flows through the pre-evaporator 18 in which approximately one third of the refrigerant mass flow is evaporated. The mixture of the liquid and gaseous refrigerant is thereafter separated in the separator 20 into a substantially gaseous portion and a substantially liquid portion. The substantially liquid portion flows by means of a choke to the low temperature evaporator 28 in which said substantially liquid portion is evaporated (for the most part). Subsequent thereto, the refrigerant is suctioned by the suction connection 30 into the ejector 16 and is fed anew to the pre-evaporator 18. The substantially gaseous portion of the refrigerant arrives from the separator 20 in the post-evaporator 24 in which the liquid portions that still remain are evaporated. The refrigerant in the vapour state is furthermore superheated. It then reaches the suction side of the compressor 10 by way of the internal heater 13.

The heat quantity needed to evaporate the refrigerant is supplied by the heat circuit 34. The heat transfer medium, which has a high temperature level after having flowed through the heater 36, first flows through the low temperature evaporator 24. After flowing through the low temperature evaporator 24, the heat transfer medium has a medium temperature level and flows through the pre-evaporator 18. Subsequent to leaving the pre-evaporator 18, the heat transfer medium has a low temperature level and is conducted through the low temperature evaporator 28. From there, it arrives at the heater 36 where it draws heat from the air to be cooled.

The evaporator 14 will be described in detail below using FIGS. 2 to 9.

The evaporator 14 is designed as a compact plate evaporator that is constructed from a succession of suitably formed sheets. An ejector 16 is provided in the top area directly after the refrigerant inlet of the evaporator 14. Following the ejector 16, the refrigerant flows through the pre-evaporator 18, which in this instance is arranged in the middle. The refrigerant flows vertically through the pre-evaporator 18 from top to bottom, where it enters into the separator 20. The separator is constructed by the plate bundle of the pre-evaporator 18 terminating at a distance X above the floor of the evaporator 14, the distance X being of the order of 15 to 50 mm. Under the influence of the force of gravity, the primarily liquid portion of the refrigerant is separated from the primarily gas portion in the separator 20. By way of example, the level of the primarily liquid portion of the refrigerant is sketched in FIG. 3.

The liquid phase outlet 26 extends through the separator 20 and leads to the inlet of the low temperature evaporator 28 by way of a choke. The refrigerant flows vertically upward through said low temperature evaporator, arriving at the suction connection 30 of the ejector 16. Moreover, the gas phase outlet 22 extends through the separator 20 by way of which it reaches the post-evaporator 24 through which it flows in a vertically upward direction to the outlet of the evaporator.

Figure 2:
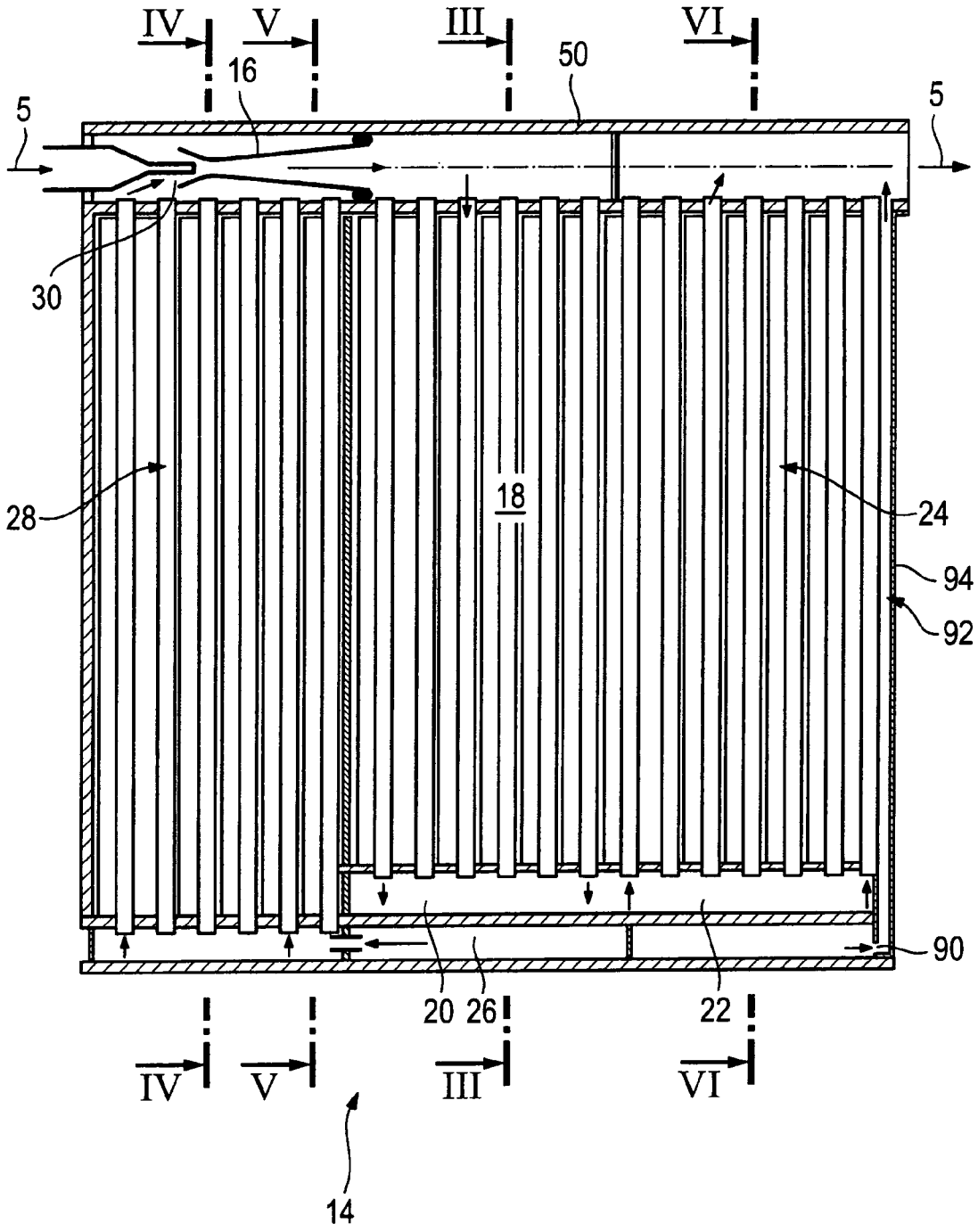
Figure 3:
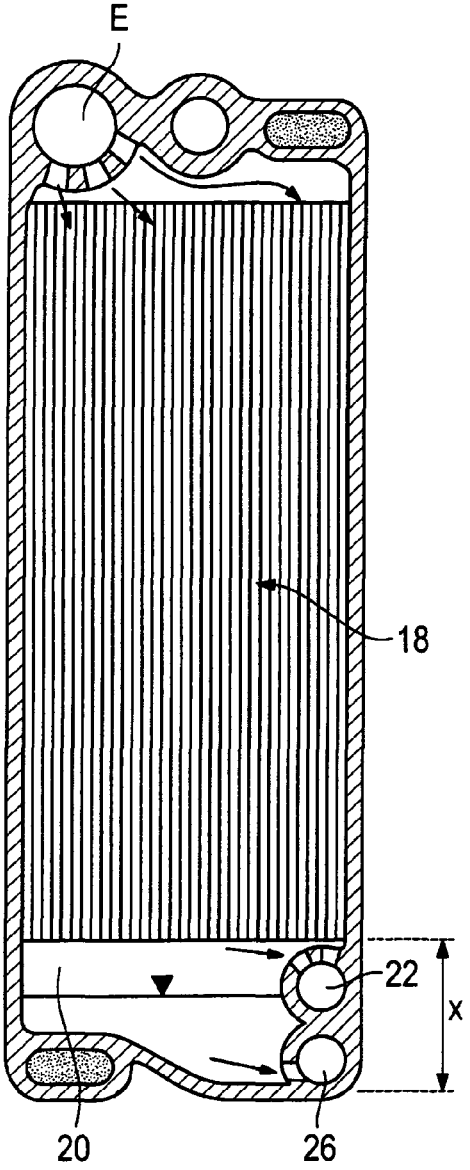
Figure 7:
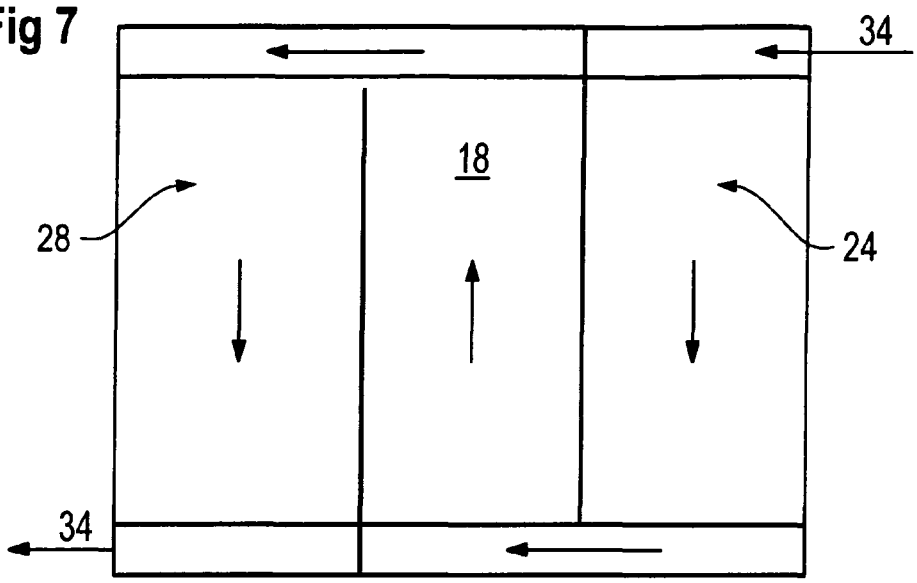
Figure 8:
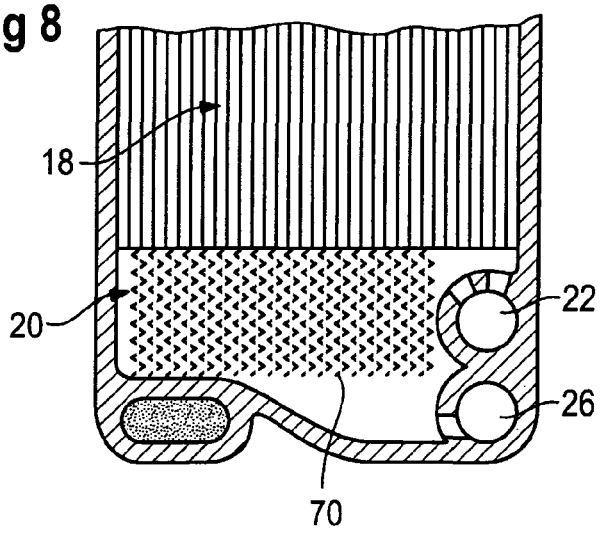
Figure 9:
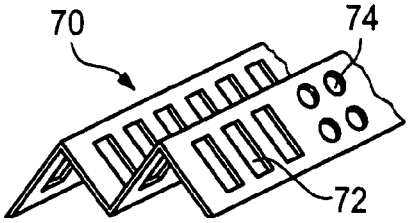
FIG. 9 represents a perspective view of a baffle plate used in the separator.

It can be seen in comparing the refrigerant direction of flow depicted in FIG. 2 with the heat transfer medium direction of flow depicted in FIG. 7 that all evaporator areas 18, 24, and 28 of the evaporator 14 work in the countercurrent process. In this manner, the existence of a uniform difference in temperature, in the broadest sense, is ensured between the heat transfer medium and the refrigerant, that is to say hot refrigerant and hot heat transfer medium flow through the same evaporator area, i.e. through post-evaporator 24 in which the refrigerant is superheated, and cold refrigerant and cold heat transfer medium flow through the same evaporator region, namely the low temperature evaporator 28.

The accumulators of the pre-evaporator 18, of the low temperature evaporator 28, and of the post-evaporator 24 are constructed by a succession of upper sections of individual plates. Moreover, the accumulators of the pre-evaporator 18, of the low temperature evaporator 28, and of the post-evaporator 24 form one accumulator 50 of the evaporator 14.

Figure 4:
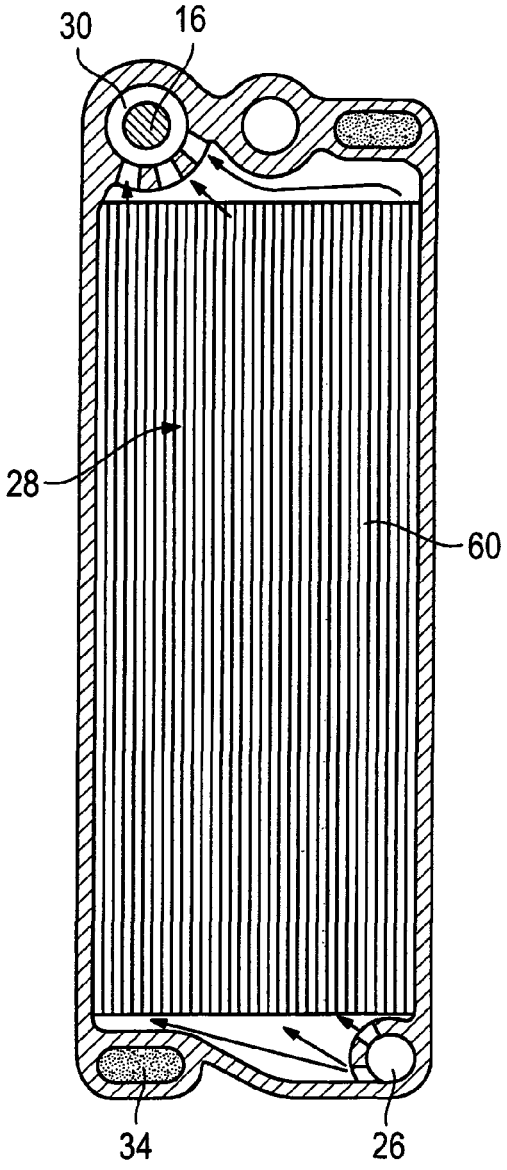
Figure 5:
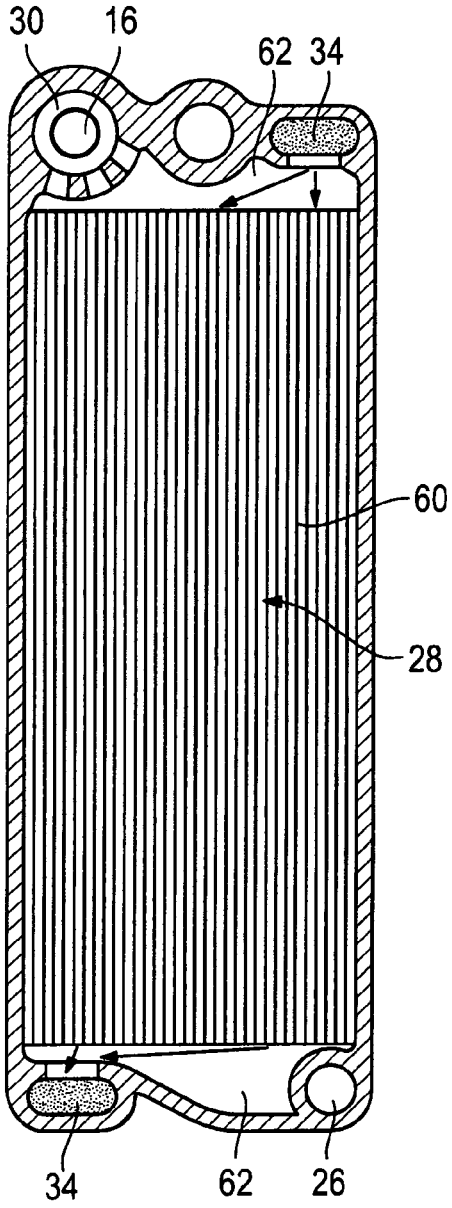

The fundamental design of the evaporator regions used in the evaporator 14 is clarified below using FIGS. 4 and 5. FIG. 4 shows a cross section between two plates between which the refrigerant flows upward in a vertical direction. FIG. 5 shows a cross section between two plates between which the heat transfer medium flows downward in a vertical direction. The corresponding plates that separate the heat transfer medium from the refrigerant extend through the entire interior of the evaporator parallel to the cross-sectional plane and the plane of projection, that is to say also above and below the herein schematically-represented zigzag sheets 60 that are arranged between the plates and serve as bracing. The canals that conduct the heat transfer medium and the canals that conduct the refrigerant are alternatingly opened in every second chamber. The zigzag sheets 60 terminate just above or below the canals for the heat transfer medium and the refrigerant in such a manner that a small distribution chamber 62 is formed above or below the zigzag sheets 60.

Figure 6:
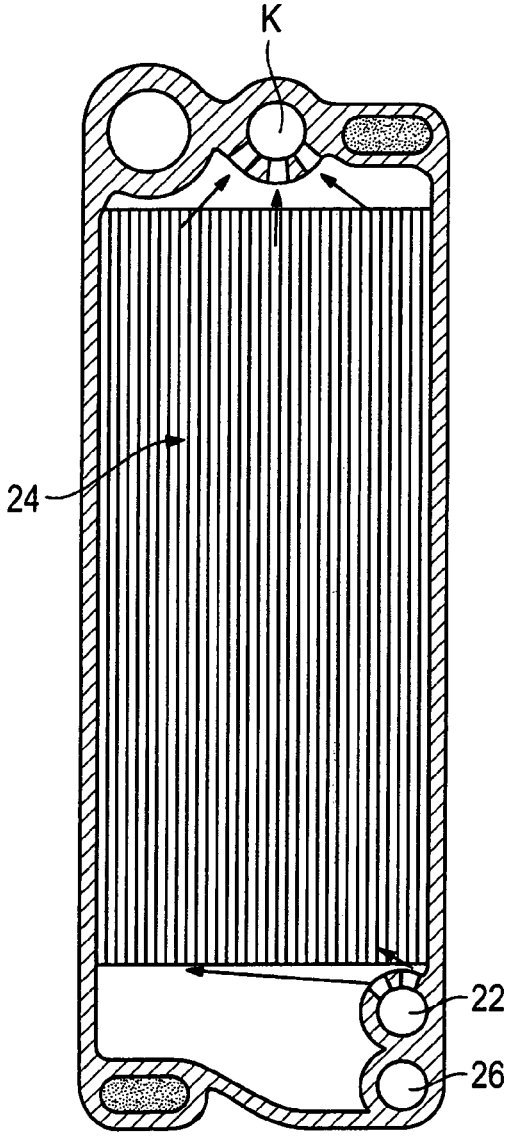

It can be seen from FIGS. 4 and 6 that the liquid phase tube 26 is arranged lower than the gas phase tube 22. The inlet openings for refrigerant in the liquid phase tube 26 of the low temperature evaporator 28 are on the floor of the liquid phase tube in the lowest possible position. The inlet openings of the gas phase tube 22 of the post-evaporator 24 are located, in contrast, on the uppermost side.

An overflow opening 90 is provided for oil that is conducted by an overflow canal 92 to the outlet of the post-evaporator 24. The overflow canal 92 is designed as a groove in the side sheet 94 of the evaporator 14, which side sheet is brazed on to stabilise the last heater plate of the post-evaporator 24. The overflow opening 90, which defines the bypass mass flow, is punched into the last heater plate and is arranged on the floor of the liquid phase tube 26. The size of the overflow opening is adjusted to the pressure drop of the plates of the post-evaporator 24 in such a manner that a bypass mass flow of oil/liquid is achieved of the order of 0.5 to 5% of the total mass flow.

Baffle plates 70 are arranged in the area of the separator 20 beneath the plate bundle of the pre-evaporator 18, which baffle plates are folded in a zigzag manner and have openings as gills 72 or holes 74, for example. The baffle plates 70 preferably consist of aluminium sheet both sides of which are coated with a brazing material. In this manner, the baffle plates can be brazed together with the plates into a unit. Together with this unit, the other components of the evaporator can also be designed, the ejector 16 in particular.

Since the inlet to the post-evaporator 24 is arranged higher than the inlet to the low temperature evaporator 28, a greater amount of primarily gaseous refrigerant is supplied to the post-evaporator 24 than to the low temperature evaporator 28. Therefore, the mass flow in the low temperature evaporator 28 is reduced to a minimum with a given capacity so as to ensure that the pressure difference between the suction connection 30 of the ejector 16 and the outlet of the ejector is maximal at point E (greatest ejector efficiency).

The separator 20 is also used in the described evaporator for heat exchange with the heat transfer medium since a heat exchange is provided for by way of the baffle plates 70 and the adjoining plates to the adjacent flow path of the heat transfer medium.

Figure 10:
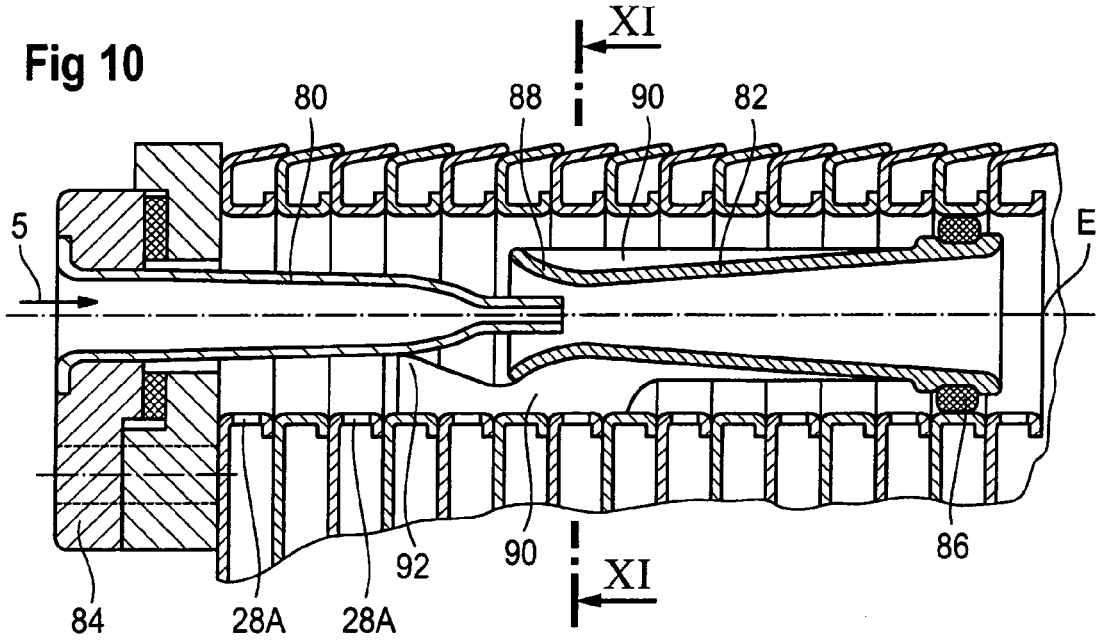
FIG. 10 represents in enlarged scale the area of the evaporator of FIG. 2 that is outfitted with the ejector.
Figure 11:
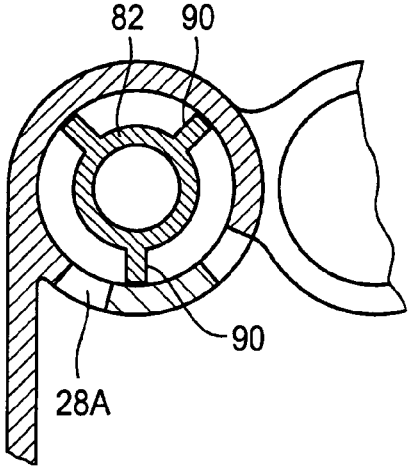
FIG. 11 represents a cross section along the plane XI-XI.

The ejector is represented in detail in FIGS. 10 and 11. Said ejector has a nozzle tube 80 and a diffuser 82 as substantial components. The end of the nozzle tube that is arranged in the evaporator has a narrowing that can be formed by bending, drawing etc. The nozzle tube has at its external end a widening that is fastened to a flange plate 84, for example by brazing. The flange plate is attached to the inlet of the evaporator in a sealed manner.

The diffuser 82 consists of plastic and is attached in the inlet tube of the evaporator by means of a seal 86. The inlet of said diffuser has a widening 86 that is designed with a radius permitting turbulence to be prevented upon entry of the refrigerant fed from the low temperature evaporator.

A plurality of integrally formed reinforcing webs 90 is arranged around the diffuser 82. They serve both to reinforce and to position the diffuser in the interior of the evaporator so that it is precisely centred on the nozzle tube 80. The reinforcing webs can also be designed so as to be elongated in the axial direction (see the reinforcing web 91 shown by way of example) in such a manner that they provide a support 92 for the nozzle tube 80. This leads to an even more precise positioning of the nozzle tube and the diffuser relative to each other.

The use of plastic for the diffuser and of metal for the nozzle tube enables an economical design satisfying respective requirements. The nozzle tube withstands the high pressures existing on the high-pressure side of the refrigerant circuit. The diffuser must withstand far lower pressures only (pressure difference of the order of 1 to 8 bar) and therefore can be manufactured from a lighter and more economically processed material.

FIG. 10 also depicts the alternately arranged outlet openings 28A of the low temperature evaporator 28. The respective chambers of the plate evaporator that are positioned therebetween are filled with the heat transfer medium.

The invention claimed is:

1. A plate evaporator (14) for circulating a refrigerant, the plate evaporator (14) having a pre-evaporator (18), a separator (20) coupled to an outlet of the pre-evaporator (18) with the separator (20) having a liquid phase outlet (26) and a gas phase outlet (22), a low temperature evaporator (28) coupled to the liquid phase outlet (26) of the separator (20), and a post-evaporator (24) coupled to the gas phase outlet (22) of the separator (20), all of which are integrated into a singular component wherein the plate evaporator (14) has an inlet and an outlet for a heat transfer medium;

wherein the heat transfer medium flows as a countercurrent through the plate evaporator (14) with respect to the direction of flow of the refrigerant in the plate evaporator (14);

wherein the heat transfer medium consecutively flows through the post-evaporator (24), the pre-evaporator (18), and the low temperature evaporator (28).

2. A plate evaporator (14) as claimed in claim 1, wherein the pre-evaporator (18), the low temperature evaporator (28), and the post-evaporator (24) each have an inlet and an outlet.

3. A plate evaporator (14) as claimed in claim 2, wherein the inlet of an accumulator of the low temperature evaporator (28) is arranged below the inlet of an accumulator of the post-evaporator (24).

4. A plate evaporator (14) as claimed in claim 1, wherein the plate evaporator (14) has an accumulator (50) in which an ejector (16) is integrated.

5. A plate evaporator (14) as claimed in claim 4, wherein the ejector (16) is positioned above the low temperature evaporator (28).

6. A plate evaporator (14) as claimed in claim 4, wherein the ejector (16) has a suction connection (30) that is directly joined to the outlet of the low temperature evaporator (28).

7. A plate evaporator (14) as claimed in claim 4, wherein the ejector (16) has an outlet (40) that is directly joined to the inlet of the pre-evaporator (18).

8. A plate evaporator (14) as claimed in claim 1, wherein the separator (20) is linked to the outlet of the pre-evaporator (18), the inlet of the post-evaporator (24), and the inlet of the low temperature evaporator (28).

9. A plate evaporator (14) as claimed in claim 1, wherein the low temperature evaporator (28) is attached to the liquid phase outlet (26) of the separator (20) and in that the post-evaporator (24) is attached to the gas phase outlet (22) of the separator (20).

10. A plate evaporator (14) as claimed in claim 1, wherein a choke (26) is arranged between the liquid phase outlet (26) of the separator (20) and the low temperature evaporator (28).

11. A plate evaporator (14) as claimed in claim 1, wherein the separator (20) is arranged beneath the pre-evaporator (18).

12. A plate evaporator (14) as claimed in claim 11, wherein the separator (20) extends to below the post-evaporator (24).

13. A plate evaporator (14) as claimed in claim 1, wherein a plate block of the pre-evaporator (18) ends at a distance of 15 to 50 mm above the floor of the separator (20).

14. A plate evaporator (14) as claimed in claim 1, wherein vertical baffle plates (70) are arranged within the separator (20) beneath a plate block of the pre-evaporator (18), wherein the baffle plates define openings that make horizontal flow through the baffle plates possible.

15. A plate evaporator (14) as claimed in claim 4, wherein the ejector (16) has a metal nozzle tube (80) and a plastic diffuser (82), and wherein the nozzle tube (80) and the diffuser (82) are integrated in an inlet canal of the plate evaporator (14).

16. A plate evaporator (14) as claimed in claim 15, wherein the nozzle tube (80) is attached on the outside of the plate evaporator (14) and the diffuser (82) is attached on the inside of the inlet canal.

17. A plate evaporator (14) for circulating a refrigerant and for circulating a heat transfer medium separate from the refrigerant, the plate evaporator (14) having:

an inlet for receiving the refrigerant and an outlet for expelling the refrigerant from the plate evaporator (14);

a pre-evaporator (18) having an outlet;

a separator (20) coupled to the outlet of the pre-evaporator (18) with the separator (20) having a liquid phase outlet (26) and a gas phase outlet (22);

a low temperature evaporator (28) coupled to the liquid phase outlet (26) of the separator (20);

a post-evaporator (24) coupled to the gas phase outlet (22) of the separator (20);

a first pathway for circulating the refrigerant from the inlet of the plate evaporator (14) through the pre-evaporator (18) to the separator (20);

a second pathway in communication with said first pathway for circulating the refrigerant from the liquid phase outlet (26) of the separator (20) through the low temperature evaporator (28) and back to the first pathway upstream from the plate evaporator (14);

a third pathway in communication with the first pathway for circulating the refrigerant from the gas phase outlet (22) of the separator (20) through the post-evaporator (24) to the outlet of the plate evaporator (14); and a fourth pathway isolated from said first, second, and third pathways for circulating the heat transfer medium though the plate evaporator (14) in a countercurrent flow through the plate evaporator (14) with respect to a direction of flow of the refrigerant through the first, second, and third pathways;

wherein the heat transfer medium consecutively flows through the post-evaporator (24), the pre-evaporator (18), and the low temperature evaporator (28).

* * * * *